US005320810A

United States Patent [19]

Al-Mahareeq et al.

[11] Patent Number: 5,320,810

[45] Date of Patent: Jun. 14, 1994

[54] PIPETTE WITH AN AXIALLY STATIONARY VOLUME ADJUSTING WHEEL

[75] Inventors: Kassab Al-Mahareeq; Hasan A. Al-Mahrouq, both of Indianapolis, Ind.

[73] Assignee: Integrated Instrument Services, Inc., Indianapolis, Ind.

[21] Appl. No.: 882,116

[22] Filed: May 13, 1992

[51] Int. Cl.[5] ..... B01L 3/02

[52] U.S. Cl. ..... 422/100; 73/864.13; 73/864.14; 73/864.16

[58] Field of Search ..... 422/100; 73/864.13, 73/864.14, 864.15, 864.16

[56] References Cited

U.S. PATENT DOCUMENTS

| | | | |
|---|---|---|---|
| 3,232,117 | 2/1966 | Gilmont | 73/864.13 |
| 3,615,240 | 10/1971 | Claude | 73/864.13 |
| 3,827,305 | 8/1974 | Gilson et al. | 73/425.6 |
| 4,098,125 | 7/1978 | Lee | 73/864.13 |
| 4,120,205 | 10/1978 | Ripphahn et al. | 73/864.13 |
| 4,165,646 | 8/1979 | Shapiro | 73/864.13 |
| 4,250,755 | 2/1981 | Kenney | 73/864.13 |
| 4,263,257 | 4/1981 | Metsala | 422/100 |
| 4,268,481 | 5/1981 | Souvaniemi et al. | 422/100 |
| 4,362,063 | 12/1982 | Marteau d'Autry | 73/864.13 |
| 4,501,163 | 2/1985 | MacDermott et al. | 73/864.13 |
| 4,728,501 | 3/1988 | Atake | 422/100 |
| 4,824,642 | 4/1989 | Lymann et al. | 422/100 |
| 5,104,624 | 4/1992 | Labriola | 422/100 |
| 5,104,625 | 4/1992 | Kenney | 422/100 |

*Primary Examiner*—James C. Housel
*Assistant Examiner*—Ramon Torres
*Attorney, Agent, or Firm*—Baker & Daniels

[57] ABSTRACT

An adjustable hand-held pump adapted to measure microliter quantities of liquids includes a frame having a handle with a cylindrical opening formed therein. A threaded shaft is disposed and slidable within the cylindrical opening. A volume adjustment wheel is rotatably disposed within the frame at a stationary axial position and mechanically engages the threaded shaft to position the threaded shaft at a predetermined axial position within the cylindrical opening, thereby providing liquid volume adjustment.

6 Claims, 4 Drawing Sheets

PIPETTE WITH AN AXIALLY STATIONARY VOLUME ADJUSTING WHEEL

FIELD OF THE INVENTION

This invention relates to pipettes, and, in particular, to pipettes having mechanisms for controlling the amount of fluid received and discharged.

BACKGROUND OF THE INVENTION

Adjustable hand held pipettes have been widely used in liquid handling systems, e.g., U.S. Pat. Nos. 4,263,257 to Metsala and 4,268,481 to Suovaniemi, et al. While hand held pipettes currently in use provide precise volume adjustment and accurate volume read out, such pipettes provide volume adjustment control setters which move axially with the pipettes plunger action and which, therefore, must be adjusted while in constant motion.

Currently used seal assemblies used in hand pipettes of the type herein involved typically comprise TEFLON (a trademark of E. I. Dupont de Nemours) seal assemblies which tend to wear out at unnoticeable rates. This introduces non-reproducible errors in the transferred volume and such seal assemblies therefore include undesirable qualities.

Thus, currently used hand held pipettes have several disadvantages. In the first place, most of these adjustable pipettes use TEFLON seals that lose their sealing capability after extended use. Secondly, these pipettes are very difficult to adjust to the desired volume when the user is wearing gloves, necessary when working with radioactive or biohazardous materials. Thirdly, most of the adjustable pipettes currently in use are not autoclavable. This tends to increase the risk of bacterial contamination or infection by pathogenic organisms contained in transferred liquids. A fourth disadvantage of the most widely used adjustable pipettes is that they are not designed to provide accessible servicing and thereby save the user time and money.

OBJECTS OF THE INVENTION

It is an object of the present invention to provide a hand pipette with a stationary volumetric control which may be easily operated.

It is another object to provide an improved apparatus for ejecting used tips from a hand held pipette.

SUMMARY OF THE INVENTION

The present invention utilizes a micro conical shaft, the plunger shaft of which travels through a threaded shaft passage. This invention provides an easy hand held pipette that is adjustable without the necessity of movement of the user's hand along side with the plunger movement. The plunger is indirectly connected to a circular rod to pass through the assembly seal to pick up the set volume of liquid. Accordingly, it is the objective of the present invention to improve the precision of measuring and dispensing of microliter quantities of liquids.

Accordingly, the invention comprises, in one form thereof, an adjustable hand-held pipette adapted to measure microliter quantities of liquids includes a frame having a handle with a cylindrical opening formed therein. A threaded shaft is disposed and slidable within the cylindrical opening. A volume adjustment wheel is rotatably disposed within the frame at a stationary axial position and mechanically engages the threaded shaft to position the threaded shaft at a predetermined axial position within the cylindrical opening, thereby providing liquid volume adjustment.

The invention comprises, in another form thereof, a frame including first and second generally cylindrical openings. An elongated hollow member is disposed at one end of the frame and is in fluid communication with the first generally cylindrical opening. The elongated hollow member is formed with an inlet end adapted to receive an expendable tip. A tip ejector rod is slidably carried in the second generally cylindrical opening of the frame. An ejector knob is fixed to the tip ejector rod and is disposed at the other end of the frame. A tip ejector sleeve is fixed to the tip ejector rod at the end opposite the ejector knob and is slidable about the elongated hollow member and adapted to eject the expendable tip from the hollow elongated member.

An advantage of the present invention is that volume adjustment can be easily performed with only one hand.

Another advantage is that volume adjustment is prevented from unintentional movement, thereby preventing change in a desired pipetted volume.

Yet another advantage is that an improved seal provides a more precise and accurate volume read out and longer life time.

Still another advantage is that added protection from environmental contaminants entering the dial assembly and the threaded shaft is provided, thereby preventing moisture and other unwanted contaminants from entering the housing of the pipette and causing malfunctioning or undesirable noise in the pipetting mechanism.

A still further advantage is that the present invention provides added protection to the cone member from physical damage and accumulation of dust.

BRIEF DESCRIPTION OF THE DRAWINGS

The above-mentioned and other features and advantages of the present invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
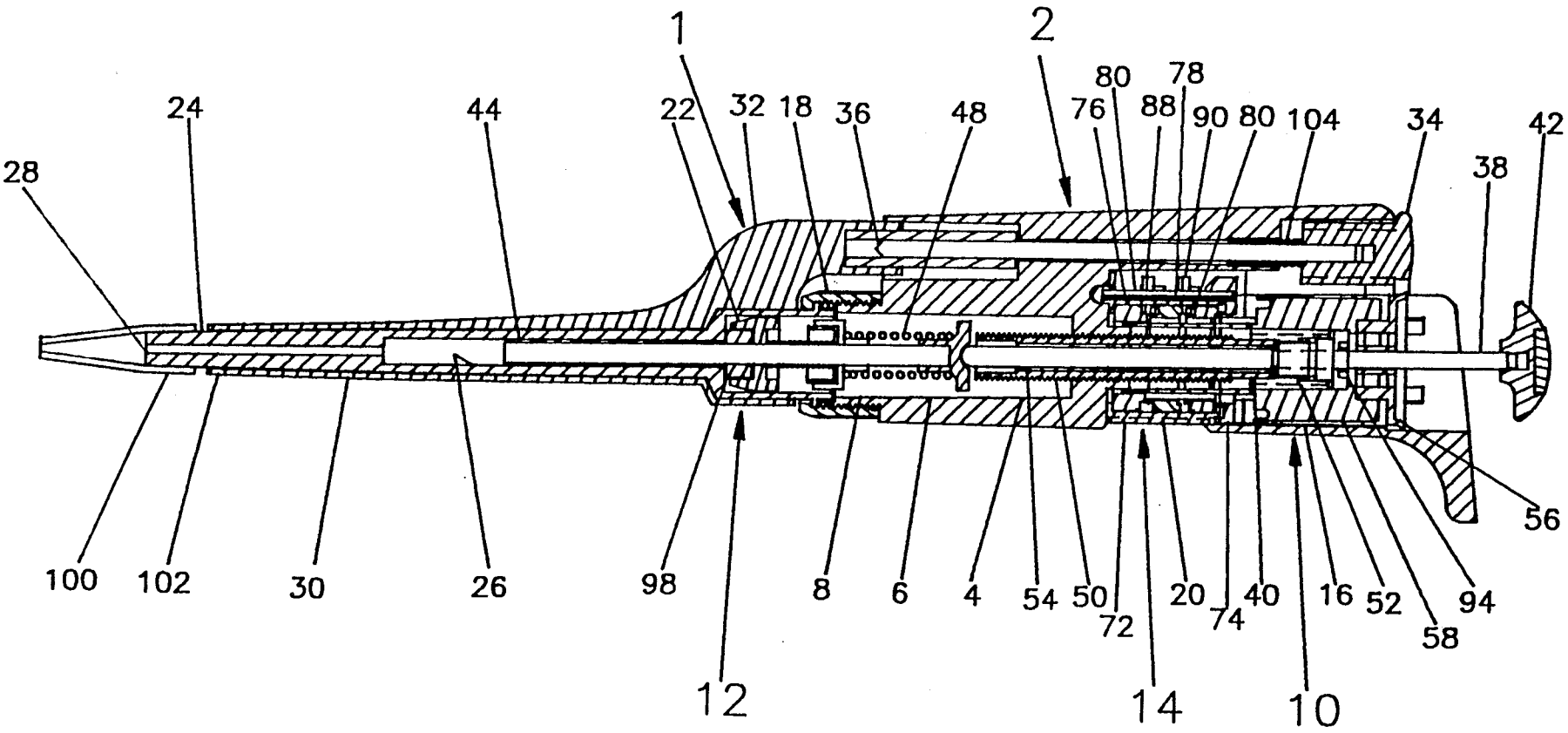
FIG. 1 is a partial sectional view of the hand adjustable pipette of FIG. 1A.
Figure 1A:
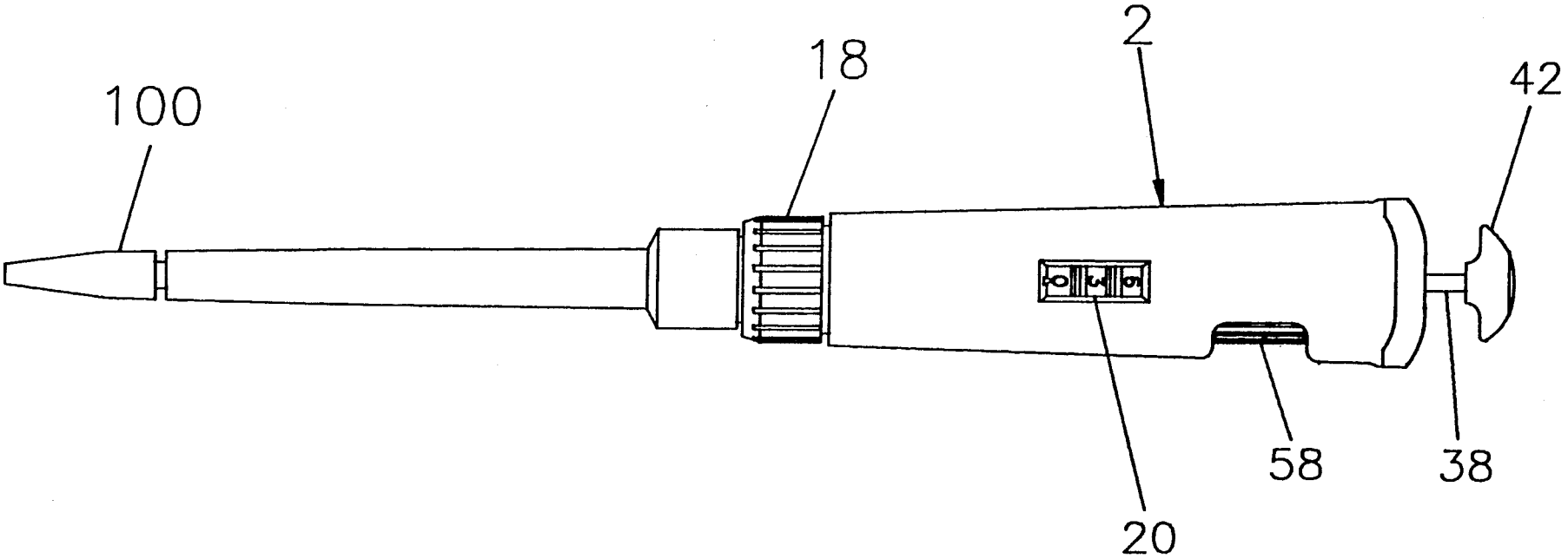
FIG. 1A is a side view of a hand adjustable pipette.

Referring now to the drawings, and particularly to FIG. 1, adjustable pipette 1 includes a frame illustrated as a handle 2 and cone member 24 slides into tip ejection sleeve 30. The cone member 24 is joined to threaded end 8 of the handle 2 by means of a joining nut 18 threaded onto the handle 2 lower end 8, within which there is a plunger 38 connected to a cylindrical piston 44, in which the cylindrical piston 44 is fitted into a seal assembly 12 providing an air tight seal between the handle 2 and the cylindrical piston 44.

Figure 2A:
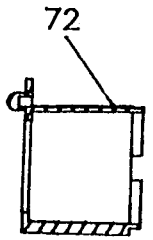
FIGS. 2A–2I show, in an exploded view, end and/or side views of various elements shown in FIG. 1.
Figure 2B:
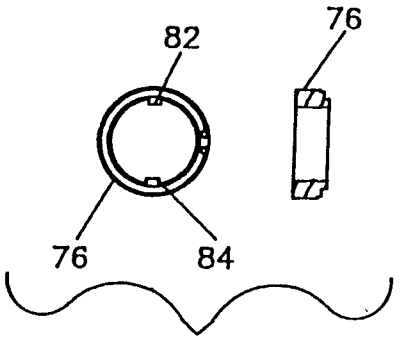
Figure 2C:
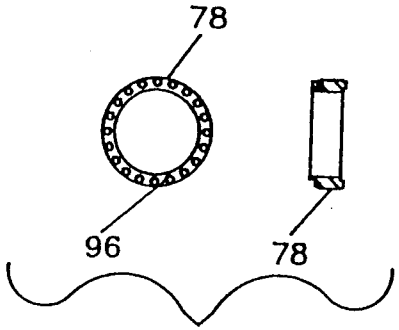
Figure 2D:
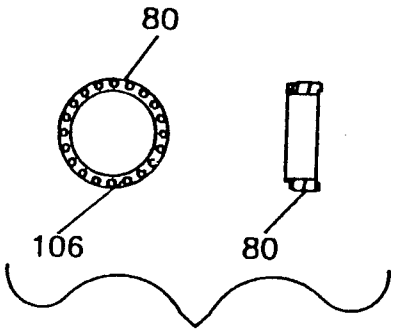
Figure 2E:
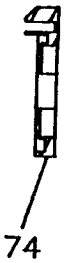
Figure 2F:
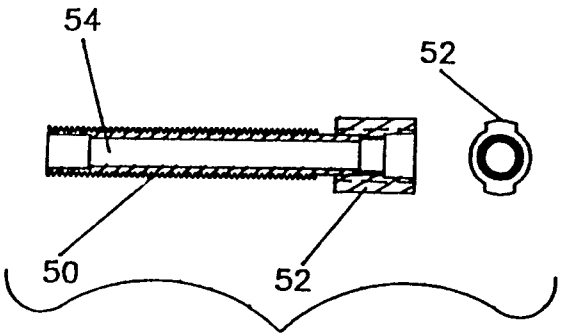
Figure 2G:
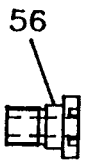
Figure 2H:
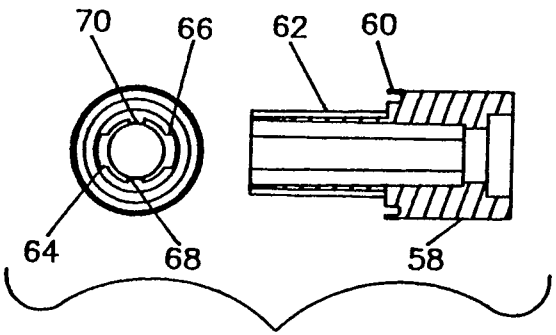
Figure 2I:
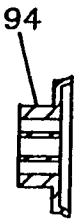
Figure 3:
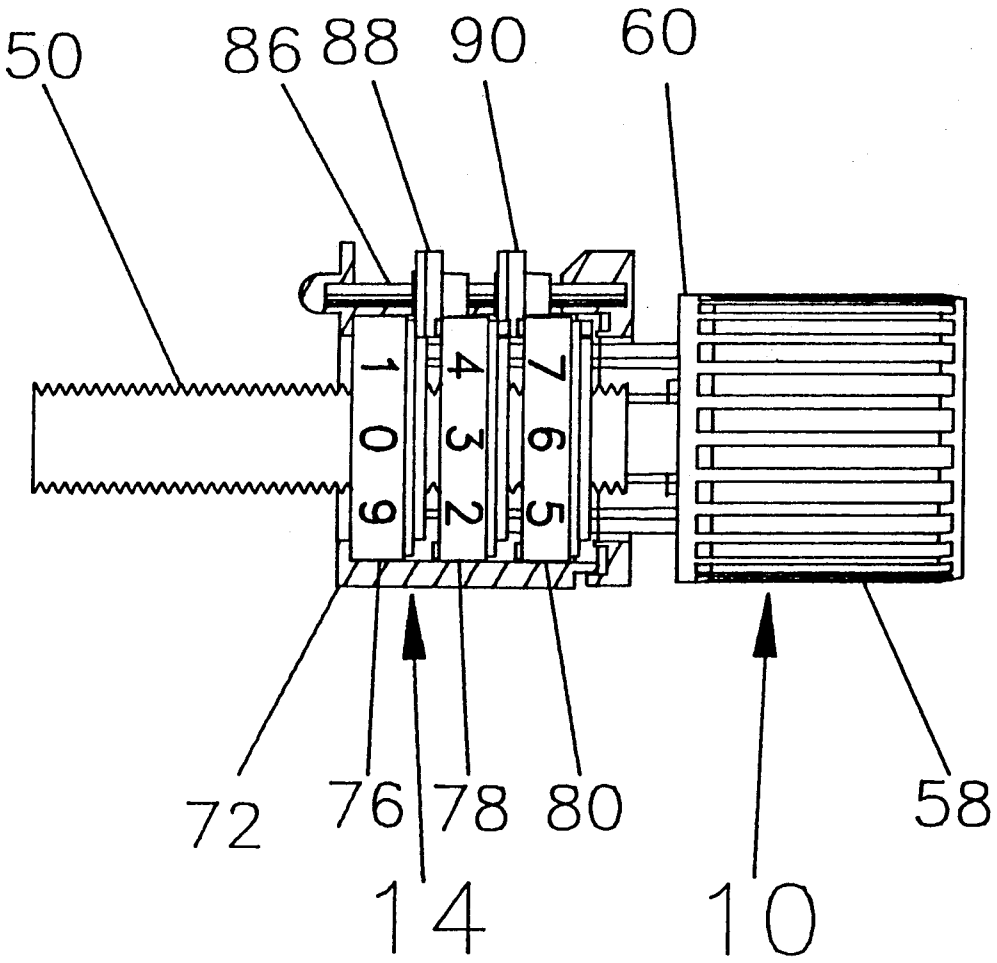
FIG. 3 is Front view of the stationary volume adjustment shown in FIG. 1.

As a more detailed illustration of the structure of the pipette 1, handle housing 4 comprises a cylindrical barrel portion 6 and an enlarged cavity 16 providing a shoulder for the stationary volume adjustment unit 10. More specifically, as illustrated in FIG. 2H, stationary volume adjustment wheel 58 includes two elongated interior tracks 64 and 66, and two exterior tracks 68 and 70. The stationary volume adjustment wheel 58 is engaged interiorly by the two opposed projections 52 of threaded shaft 50, and exterior tracks 68 and 70 slide into the two opposed inwardly extended projections 82 and 84 of dial 76. Rotating the stationary volume adjustment wheel 58 therefore provides relative rotational movement between threaded shaft 50 and volume indicator dials 76, 78 and 80. Stationary volume adjustment wheel 58 includes a larger diameter forming an outward extrusion 60 establishing a lock point to prevent any accidental changes in the volume setting indicated in the window 20.

Dial assembly 14 (FIG. 1) has a pair of opposed blocks 72 and 74 connected therebetween by a rod 86. Block 72 is defined as a clear indicator cup which contains three dials 76, 78 and 80. Blocks 72 and 74 have central openings formed therein for slidably engaging lower portion 62 of stationary volume adjustment wheel 58. Block 74 which covers the dial assembly 14 (FIG. 1), snaps into the lower end of the enlarged cavity 8 (FIG. 1).

Dial assembly 14 (FIG. 1) is calibrated to provide volume readings. Volume indicator dial 76 includes opposed, inwardly extending projections 82 and 84 which fit into one of two exterior tracks 66 and 70 formed in stationary volume adjustment wheel 58 and thereby provide dependent rotation between volume indicator dial 76 and stationary volume adjustment wheel 58. Volume indicator dials 76, 78 and 80 are stacked within the block 72. The dial assembly extra number 14 (FIG. 1) settings visible to an operator through window 20 (FIG. 1) read in units of tenths and hundreds of microliters. Rotating the stationary volume adjustment wheel 58 will rotate the threaded shaft 50 and cause the dials to rotate two gears 88 and 90 in either direction. Gears 88 and 90 are mounted for free rotation on rod 86 and engages a 360° gear ring 96 on dial 78 and gear ring 106 on dials 80. Dials 76, 78 and 80 carry equally spaced numerals 1.2.3.4.5.6.7.8.9. and 0. The top end of the housing 4 (FIG. 1) is closed by a device cover 94 that limits the vertical movement of the stationary volume adjustment unit 10.

As shown in FIG. 1 the pipette 1 can be operated by rotating the stationary volume adjustment wheel 58 to the desired position where dial assembly 14 is viewed through window 20 to show the desired microliter of liquid samples to be withdrawn and discharged. Once the desired setting is depicted, plunger knob 42 is pressed to move the plunger 38 downward. In its normal position the plunger 38 is pushed to the rear by means of a spring 48 against an adjustable nut 56 through which the plunger rod 38 extends. The adjustable nut 56 provides a rear stop against the larger diameter of the plunger 38. The spring is held in compression within the barrel 6 at the lower end of the handle 2. The stop member 40 of the plunger is composed of a larger diameter portion of the plunger 38 when in a small diameter of the extended rod. The stop member is held against an adjustable nut screwed into a threaded shaft.

Cone member 24 is comprised of an enlarged section at the upper end 22 and provides a shoulder for the O-Ring seal 98. Cone member 24 includes an elongated hollow section 26 providing the cylindrical piston 44 sufficient traveling distance to draw liquid samples. A disposable tip 100 is frictionally fitted on to the inlet end 28 of cone member 24. Narrow passageway in the inlet end 28 provides fluid communication between the interior of the tip 100 and the cylindrical piston 44.

The tip ejecting assembly includes a tip ejector sleeve 30 having a J-shaped end 32 that slides axially about cone member 24 which it encircles. The J-shaped 32 of the tip ejector sleeve 30 is connected to an ejector knob 34 through a tip ejector rod 36 that snaps into the J-shaped end 32 of tip ejector sleeve 30. A spring 104 contained in the handle 2 keeps the tip ejector sleeve 30 in a normal upward position allowing the tip 100 to be seated on the cone member 24.

Liquid samples are drawn into a disposable tip 100 and discharged by plunger 38 which is pushed onto a cylindrical piston 44. The plunger rod 38 travels to the rear through a passage 54 formed in threaded shaft 50. A plunger knob 42 is snapped onto the plunger 38. After the operator has dispensed the liquid sample, the operator may press the ejector knob 34 which pushes the tip ejector sleeve 30 downward along the cone member 24. Engaging end 102 of ejector sleeve 30 then contacts and ejects the used tip 100. By depressing the pipettes plunger knob 42, the operator can eject the tip with one-handed operation.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An adjustable hand-held pipette adapted to measure microliter quantities of liquids, said pipette comprising:

a frame, said frame comprising a handle having a cylindrical opening;

a threaded shaft slidable within said cylindrical opening;

a volume adjustment wheel rotatably disposed within said frame at a stationary axial position relative to said frame when rotating the volume adjustment wheel, said volume adjustment wheel being rotatable by a person to adjust the quantity of liquid capable of being received or discharged by the pipette, said volume adjustment wheel mechanically engaging said threaded shaft to position said threaded shaft at a predetermined axial position with respect to the frame within said cylindrical opening by rotating the volume adjustment wheel, thereby providing a liquid volume adjustment;

a volume indicator dial mechanically engaged with said volume adjustment wheel for providing a visual indication of said liquid volume adjustment; and a plunger extending from said frame and operable to discharge liquid from the pipette, the plunger being axially movable with respect to the frame while the volume adjustment wheel remains axially stationary with respect to the frame, wherein said plunger is mechanically disengaged from said volume indicator dial such that rotation of said plunger does not produce rotation of said volume indicator dial.

2. The pipette of claim 1 wherein said stationary volume adjustment wheel includes a generally cylindrical passageway for receiving said threaded shaft, said generally cylindrical passageway formed with two opposing exterior tracks engaging said volume indicator dial, one said exterior track coupled to said volume indicator dial and thereby providing dependent rotation between said stationary volume adjustment wheel and said volume indicator dial.

3. The pipette of claim 2 wherein said cylindrical passageway of said stationary volume adjustment wheel further includes two opposing elongated interior tracks, and said threaded shaft includes two projections, said two projections adapted to slidingly engage said two elongated interior tracks such that said threaded shaft is limited to movement in either axial direction.

4. The pipette of claim 1 wherein said stationary volume adjustment wheel further includes an outward extrusion providing sufficient friction against said cylindrical opening of said frame to prevent unintentional axial movement of said stationary volume adjustment wheel.

5. The pipette of claim 1 further comprising a cover disposed in said cylindrical passageway of said frame to prevent said stationary volume adjustment wheel from moving in an axial direction when said stationary volume adjustment wheel is disposed in said cylindrical opening of said frame.

6. The pipette of claim 5 wherein said cover is press fit into said cylindrical passageway of said frame.

* * * * *